US007992802B2

(12) United States Patent
Wang

(10) Patent No.: US 7,992,802 B2
(45) Date of Patent: Aug. 9, 2011

(54) SPRINKLER

(76) Inventor: Cheng-An Wang, Chang Hua Hsien (TW)

( * ) Notice: Subject to any disclaimer, the term of this patent is extended or adjusted under 35 U.S.C. 154(b) by 156 days.

(21) Appl. No.: 12/429,095

(22) Filed: Apr. 23, 2009

(65) Prior Publication Data

US 2010/0270398 A1 Oct. 28, 2010

(51) Int. Cl.
*B05B 3/00* (2006.01)

(52) U.S. Cl. ..... 239/246; 239/230; 239/231; 239/233; 239/249; 239/392; 239/394

(58) Field of Classification Search ..... 239/71, 239/230, 231, 233, 246, 249, 390–392, 394, 239/587.1, 587.4
See application file for complete search history.

(56) References Cited

U.S. PATENT DOCUMENTS 2,944,743 A * 7/1960 Kachergis ..... 239/230
3,779,462 A * 12/1973 Bruninga ..... 239/230
3,918,642 A * 11/1975 Best ..... 239/230
4,130,247 A * 12/1978 Healy ..... 239/396
5,377,914 A * 1/1995 Christen ..... 239/252
6,095,432 A * 8/2000 Casagrande ..... 239/230
6,182,909 B1 * 2/2001 Kah et al. ..... 239/394

* cited by examiner

*Primary Examiner* — Steven J Ganey
(74) *Attorney, Agent, or Firm* — Egbert Law Offices PLLC

(57) ABSTRACT

The present invention provides a bumping-type sprinkler. The sprinkler includes a main body, where an inlet pipe coupling end is mounted at the lower end, an upper frame is mounted at the upper end, and a water outlet is arranged at lower flange nearby the upper frame. A revolving member, arranged onto the upper frame of the main body, has a torsional spring and a revolving portion. An outflow turntable is assembled corresponding to the water outlet of the main body. A pivot portion is placed centrally on the outflow turntable for screwing it laterally on the water outlet at interval. A plurality of outflow guide holes are arranged at intervals along a circular path of the eccentric circumferential portion of the outflow turntable. The outflow guide holes can be located corresponding to the water outlet in line with the change of rotation/displacement angle of the outflow turntable.

3 Claims, 7 Drawing Sheets

SPRINKLER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a sprinkler, and more particularly to an innovative bumping-type sprinkler with an outflow turntable at the water outlet.

2. Description of Related Art Including Information Disclosed Under 37 CFR 1.97 and 37 CFR 1.98.

Common gardening sprinklers, including those referred to as bumping sprinklers that rotate automatically during water spraying, are structurally composed of a main body, an inlet pipe, an upper frame, a revolving member and an outlet pipe. The outlet pipe is located upwards at one side of the main body, such that when the water is guided from inlet pipe to the outlet pipe. A parabolic water column can be formed due to oblique configuration of the outlet pipe, leading to automatic sprinkling and irrigation in tune with the revolving member.

However, the following shortcomings are observed during actual applications.

When a prior art bumping sprinkler is used for water spraying, a parabolic spraying distance is formed due to a preset oblique configuration of the outlet pipe, and a deflection spraying with circular or directional motion can also be generated from the arrangement of revolving member. Yet, the discharge head of such bumping sprinkler is generally a fixed aperture to ensure consistent water discharge, leading to limited water flow regulation. Alternatively, a removable discharge head is formed so that water flow can be changed freely by replacing the discharge head of different apertures. However, the users may find it difficult to store the discharge heads of other apertures, leading possibly to loss of the discharge heads and inconvenience of use.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention.

Based on the sprinkler of the present invention, the water outlet of the main body is provided with a rotary outflow turntable. The outflow rate or mode of the bumping sprinkler can be adjusted through rotation of the outflow turntable, realizing more convenient and flexible operation for diversified requirements in the applications.

There are improvements brought about by this invention.

Based on the structure of the present invention, the snappers are arranged at an inner side of the outflow turntable corresponding to the outflow guide holes, and a flexible ejector pin is arranged laterally on the water outlet. The flexible ejector pin and snapper are locked simultaneously by the mating of outflow guide holes and water outlet, enabling accurate positioning of the rotating outflow turntable and convenient adjustment of its angle.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
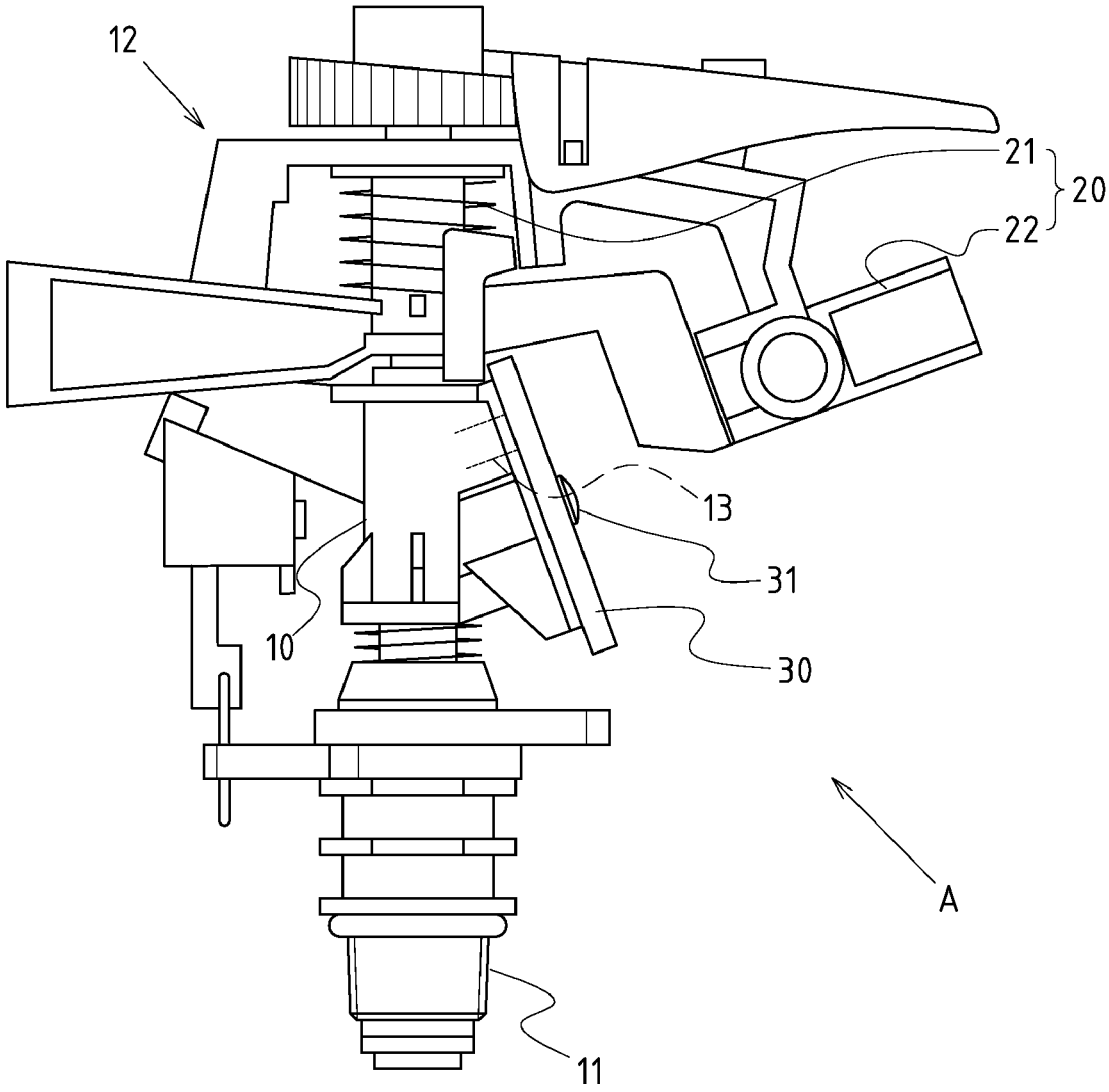
FIG. 1 shows a side elevation view of preferred embodiment of the bumping sprinkler of the present invention.
Figure 2:
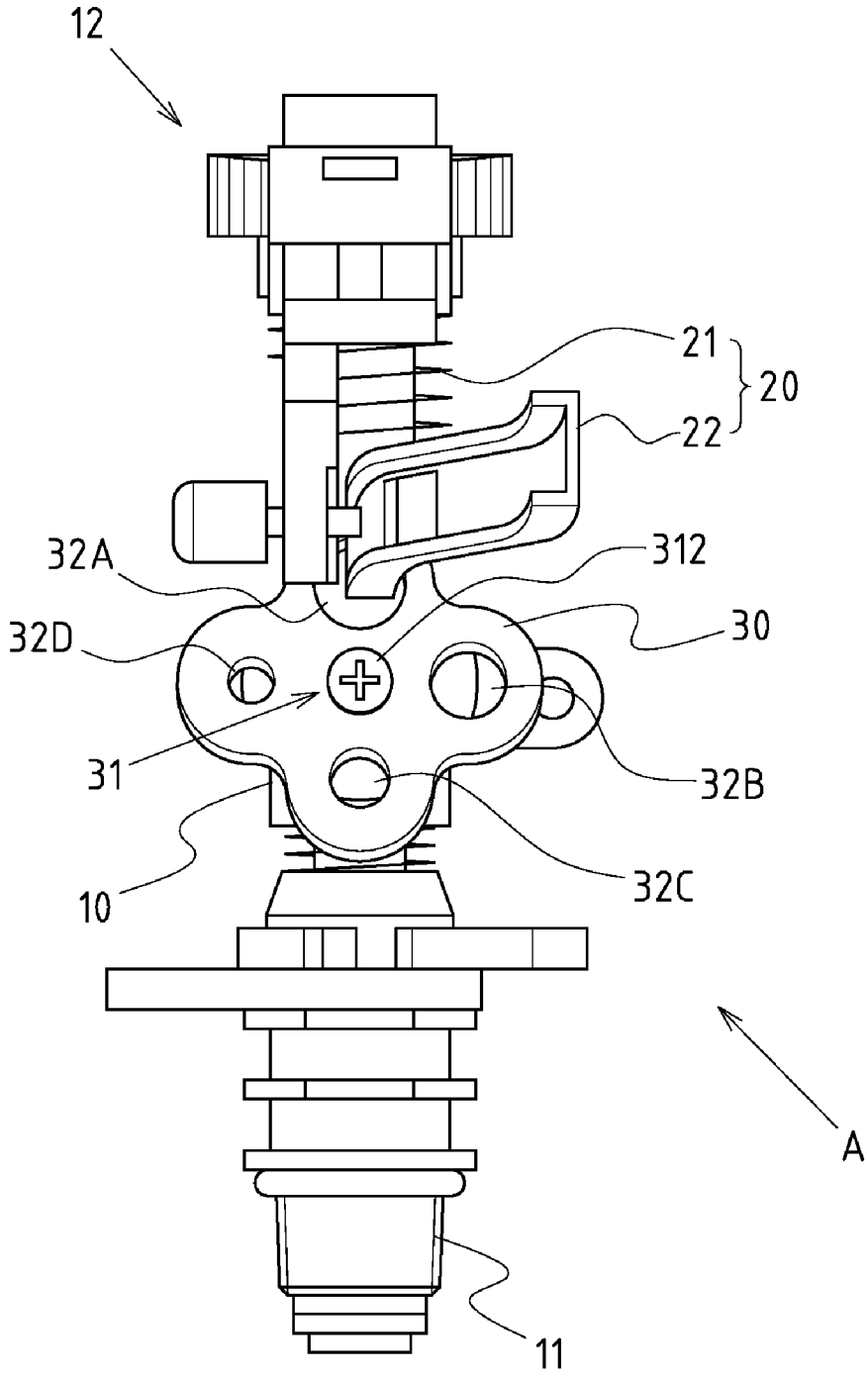
FIG. 2 shows a front elevation view of preferred embodiment of the bumping sprinkler of the present invention.

FIGS. 1-5 depict preferred embodiments of the sprinkler of the present invention. The embodiments are provided for only explanatory purposes with respect to the patent claims.

The sprinkler A comprises a main body 10, where an inlet pipe coupling end 11 is mounted at the lower end, and an upper frame 12 at the upper end. A water outlet 13 is arranged at lower flange nearby the upper frame 12.

The sprinkler also comprised a revolving member 20, which is arranged onto the upper frame 12 of the main body 10. The revolving member 20 comprises a torsional spring 21 and a revolving portion 22.

An outflow turntable 30 is assembled corresponding to the water outlet 13 of the main body 10. A pivot portion 31 is placed centrally on the outflow turntable 30 for screwing it laterally on the water outlet 13 at interval, such that the eccentric circumferential portion of the outflow turntable 30 is abutted onto the water outlet 13 in a rotary state. A plurality of outflow guide holes 32A, 32B, 32C, 32D are arranged at intervals along a circular path of the eccentric circumferential portion of the outflow turntable 30. The outflow guide holes 32A-32D can be located corresponding to the water outlet 13 in line with the change of rotation/displacement angle of the outflow turntable 30. Moreover, the outflow guide holes 32A-32D of different patterns are shown in 6, wherein the outflow guide holes 32A, 32B, 32C, 32D have different apertures (i.e.: 32A>32B>32C>32D).

The pivot portion 31 of the outflow turntable 30 contains a through hole 311 and a bolt 312, so that a tapped hole 14 is arranged laterally onto the water outlet 13 for screwing of the bolt 312.

Figure 3:
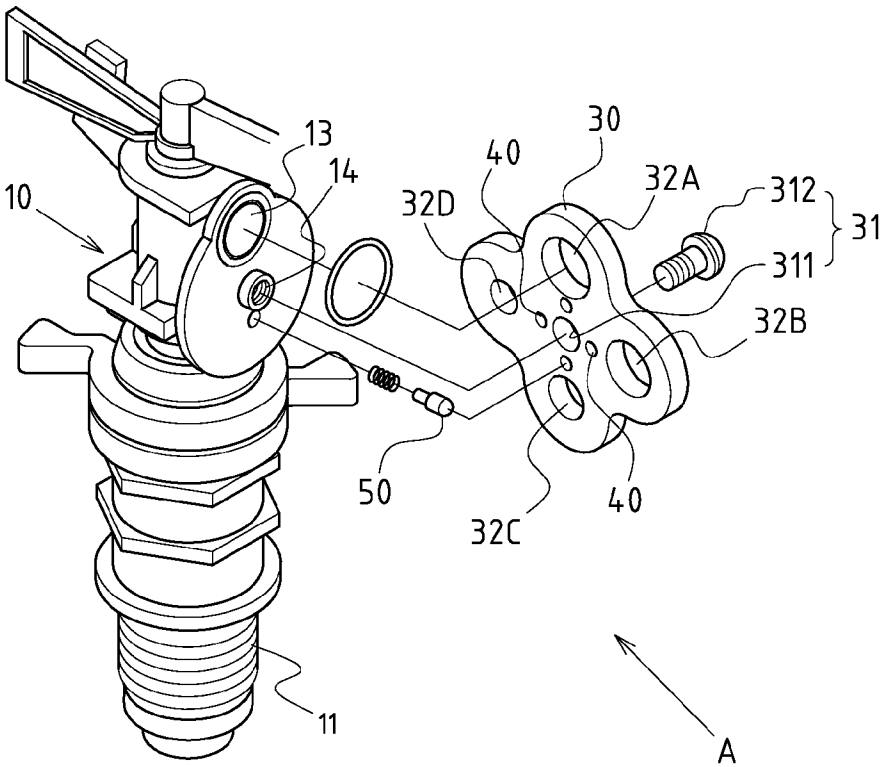
FIG. 3 shows an exploded perspective view of outflow turntable and main body of the present invention.
Figure 5:
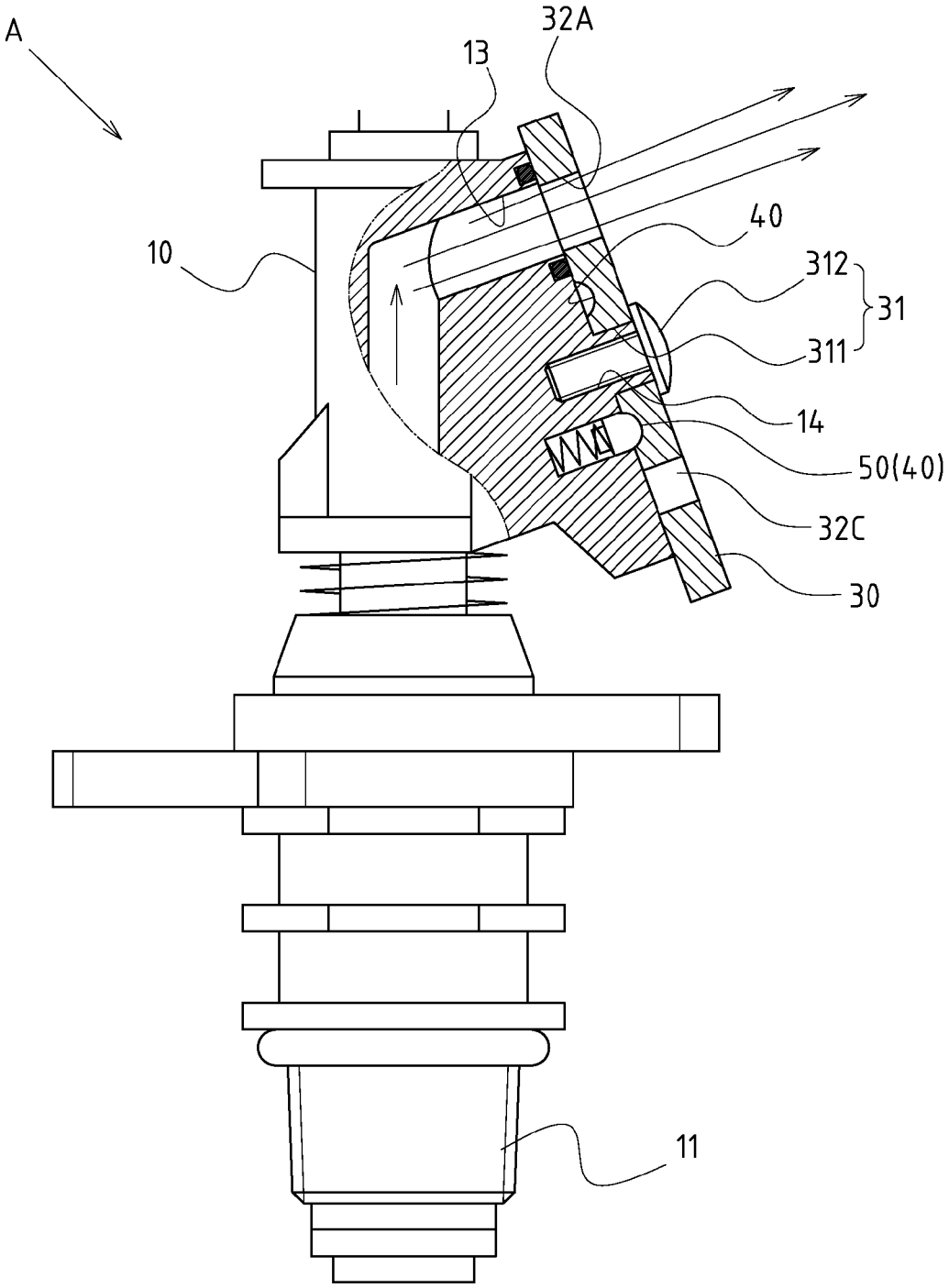
FIG. 5 shows a partial sectional view and partial side elevational view of an assembled outflow turntable and main body of the present invention.

Referring to FIGS. 3 and 5, snappers 40 are arranged at inner side of the outflow turntable 30 corresponding to the outflow guide holes 32A, 32B, 32C, 32D, so that a flexible ejector pin 50 is arranged laterally on the water outlet 13. In such a case, the flexible ejector pin 50 and snapper 40 are locked simultaneously by the mating of outflow guide holes 32A, 32B, 32C, 32D and water outlet 13, enabling the positioning of outflow turntable 30 in rotation and displacement.

Figure 4:
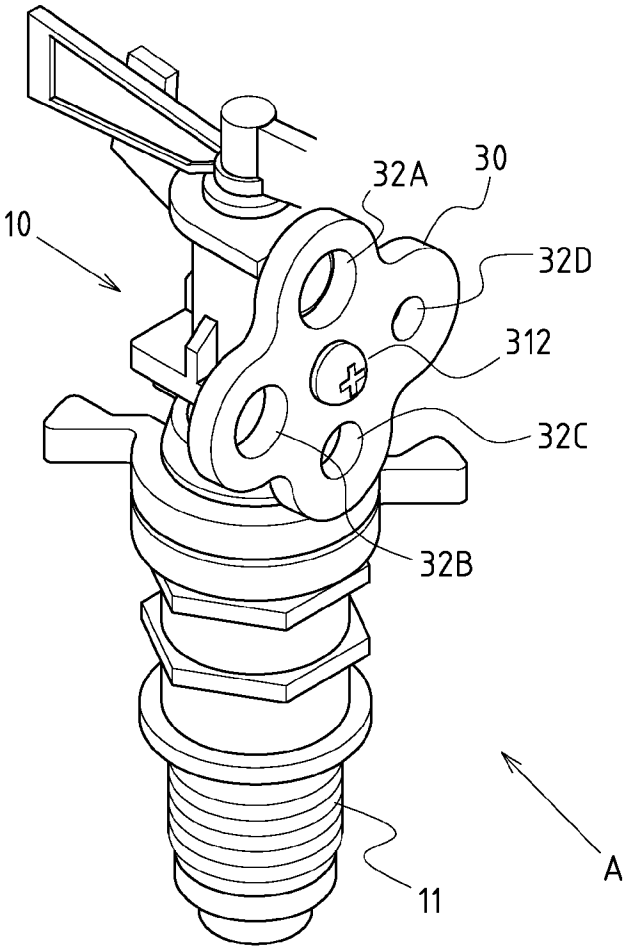
FIG. 4 shows an assembled perspective view of outflow turntable and main body of the present invention.
Figure 6:
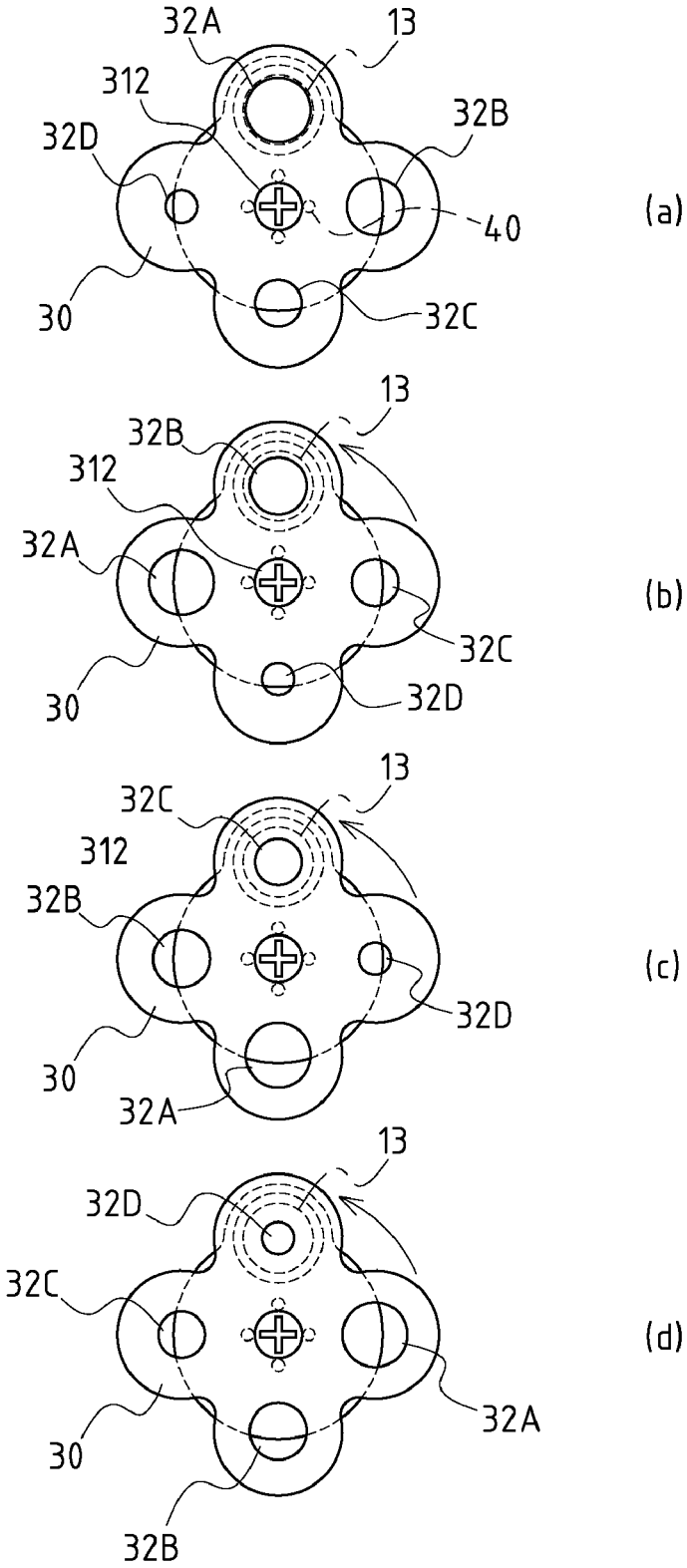
FIG. 6 shows schematic views (a)~(d) showing the adjustment state of the outflow turntable of the present invention.

Based on above-specified structures, the present invention is operated as follows:

Referring to FIG. 5, the bumping sprinkler A is operated in such a manner that the mating of the outflow guide holes 32A, 32B, 32C, 32D and water outlet 13 of the main body 10 can be adjusted with the rotation and displacement of the outflow turntable 30 (referring also to FIG. 4). FIG. 6(*a*)-(*b*) depict the mating state of the outflow guide holes 32A, 32B, 32C, 32D and water outlet 13. With the help of outflow guide holes 32A, 32B, 32C, 32D of different apertures, it is possible to adjust the outflow modes and change the water spraying distance to meet diversified spraying and irrigation requirements.

Figure 7:
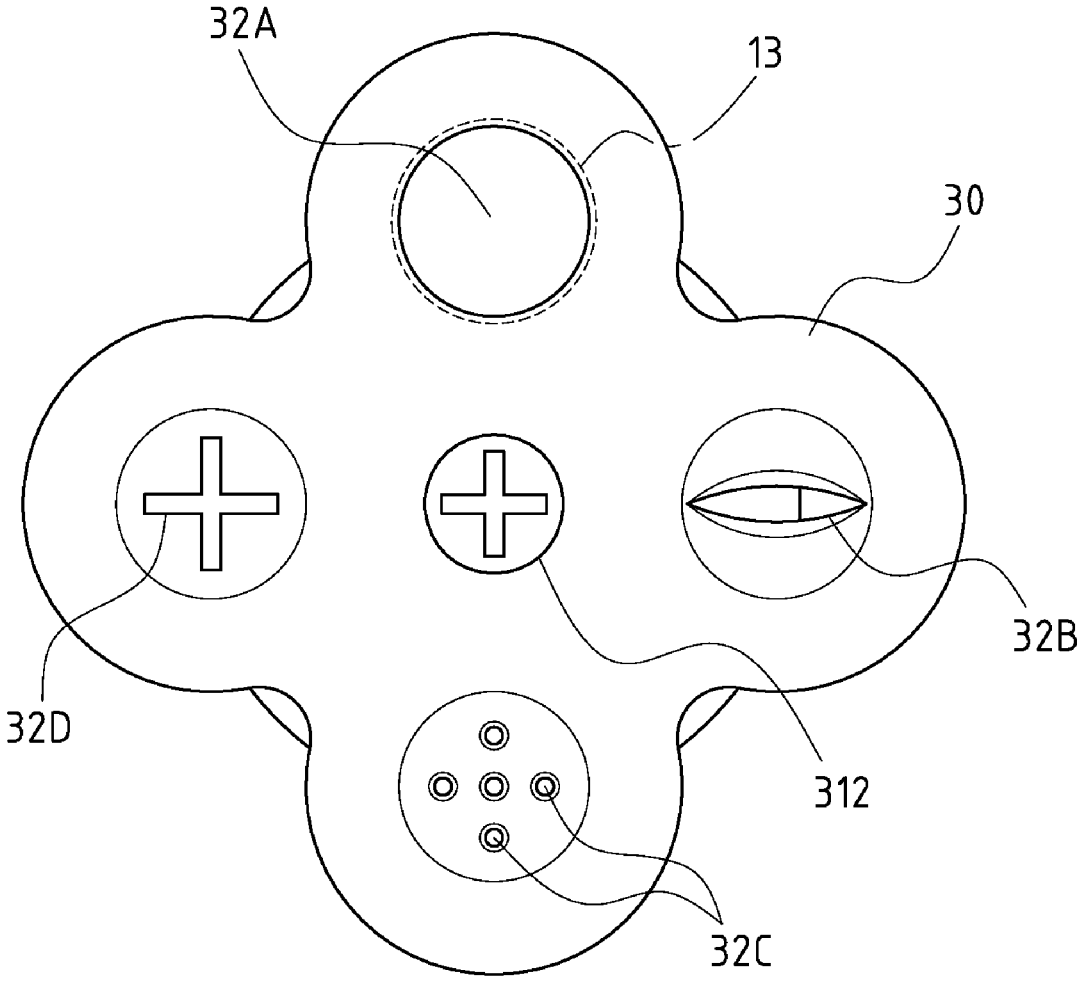
FIG. 7 shows a top plan view of another preferred embodiment of the outflow guide holes of outflow turntable of the present invention.

Referring also to FIG. 7, the outflow guide holes 32A, 32B, 32C, 32D can also be designed into various shapes with holes (e.g. straight hole, cross hole, round hole and mesh hole), thus realizing various water discharge modes.

Figure 8:
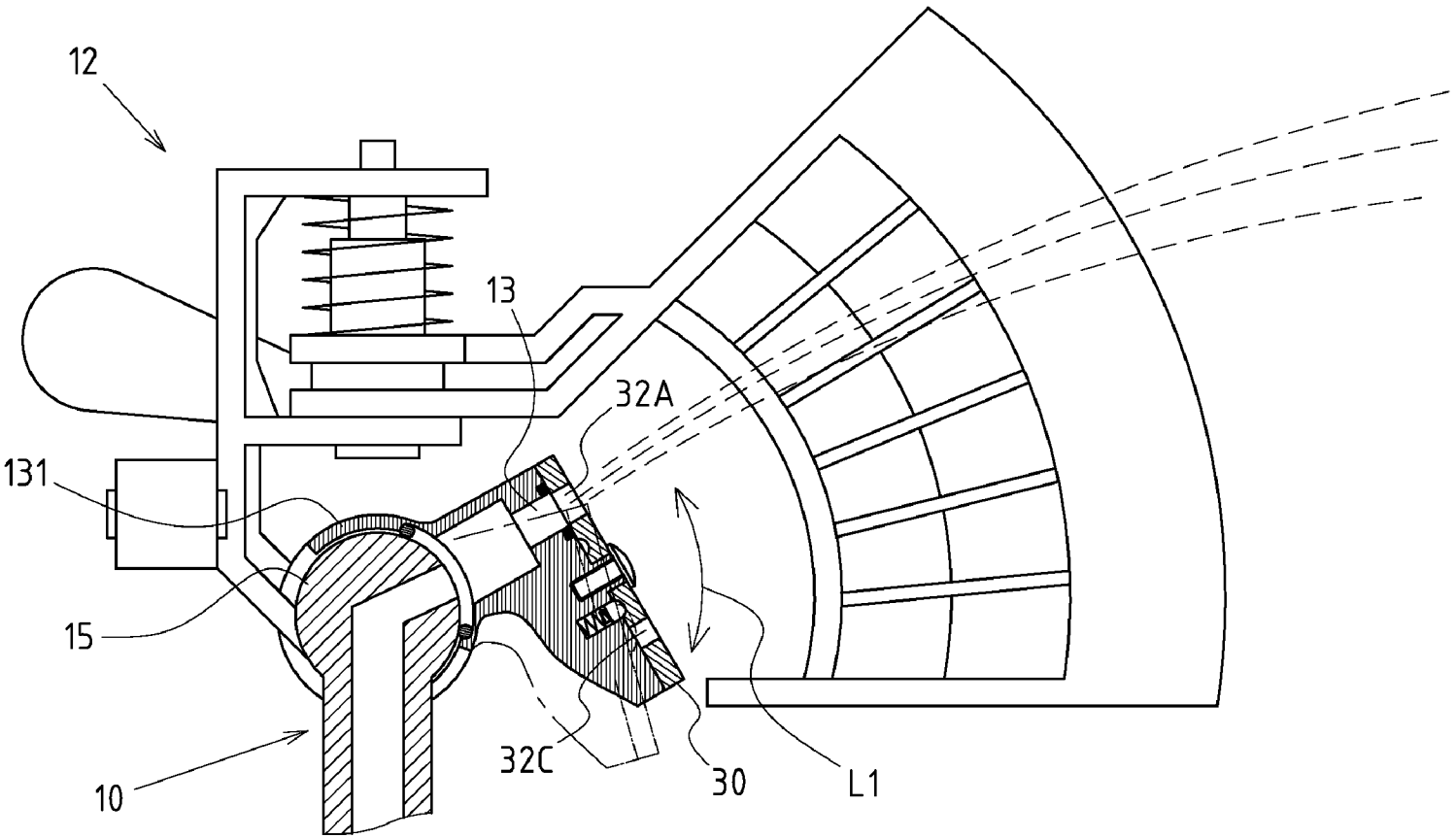
FIG. 8 shows a partial sectional view and partial elevation view of the preferred embodiment of the present invention, showing the water outlet of main body with an adjustable elevation angle for water spraying.

Referring also to FIG. 8, the water outlet 13 of the main body 10 can also be designed with adjustable elevation angle for spraying purpose. In the preferred embodiment, the water outlet 13 is assembled onto a column 15 on top of the main body 10 via a cylindrical portion 131, so that the water outlet 13 can swing vertically along with the outflow turntable 30 (shown by arrow L1), making it possible to adjust the spraying angle and range.

I claim:

1. A sprinkler apparatus comprising:

a main body having an inlet end coupling at a lower end thereof and an upper frame at an upper end thereof, said main body having a flanged surface adjacent said upper frame, said flanged surface having a water outlet at a perimeter thereof, said flanged surface having a tubular member extending outwardly centrally thereof, said tubular member having a tapped hole formed therein, said flanged surface having a receptacle formed therein adjacent said tubular member;

a revolving member positioned onto said upper frame of said main body, said revolving member having a torsional spring and a revolving portion;

an outflow turntable having a hole formed centrally thereof, said hole of said outflow turntable receiving said tubular member of said flanged surface therein such that a back surface of said outflow turntable resides against said flanged surface, said outflow turntable having a plurality of outflow guide holes in spaced relation along a circular path adjacent a periphery thereof, said outflow turntable being rotatable such that one of said plurality of outflow guide holes overlies said water outlet, each of said plurality of outflow guide holes having a different pattern, said back surface of said outflow turntable having snapper indents adjacent said hole thereof and aligned respectively with said plurality of outflow guide holes;

a bolt threadedly received by said tapped hole of said tubular member, said bolt has a head with a periphery overlying a front face of said outflow turntable so as to retain said back face of said outflow turntable against said flanged surface; and an ejector received in said receptacle of said flange surface of said main body, said ejector having a pin member and a spring in which said spring urges said pin member outwardly of said receptacle, said pin member having an end opposite said spring selectively engageable with one of said plurality of snapper indents when a corresponding one of said plurality of outflow guide holes is positioned directly over said water outlet.

2. The sprinkler apparatus of claim 1, said outflow guide holes being of different sizes.

3. The sprinkler apparatus of claim 2, said outflow guide holes being of different shapes.

* * * * *